US008314515B2

(12) United States Patent
Wang et al.

(10) Patent No.: US 8,314,515 B2
(45) Date of Patent: Nov. 20, 2012

(54) SYSTEM CORRECTED PROGRAMMABLE INTEGRATED CIRCUIT

(75) Inventors: Yen-Hui Wang, Hsinchu (TW); Wei-Chun Hsiao, Jhonghe (TW)

(73) Assignee: Grenergy Opto, Inc., Hsinchu Science Park, Hsinchu (TW)

( * ) Notice: Subject to any disclaimer, the term of this patent is extended or adjusted under 35 U.S.C. 154(b) by 811 days.

(21) Appl. No.: 12/496,245

(22) Filed: Jul. 1, 2009

(65) Prior Publication Data

US 2010/0271114 A1 Oct. 28, 2010

(30) Foreign Application Priority Data

Apr. 24, 2009 (TW) ..... 98113615 A

(51) Int. Cl.
*G05F 1/10* (2006.01)

(52) U.S. Cl. ..... 307/125; 307/130; 327/540

(58) Field of Classification Search ..... 307/125, 307/130; 327/540
See application file for complete search history.

(56) References Cited

U.S. PATENT DOCUMENTS 6,891,707 B2 * 5/2005 Hiyama et al. ..... 307/125
7,162,376 B2 1/2007 Oh
8,144,541 B2 * 3/2012 He et al. ..... 365/230.06
2004/0051397 A1 * 3/2004 Juntunen et al. ..... 307/130
2004/0222810 A1 11/2004 Frankowsky
2005/0206641 A1 9/2005 Morita
2010/0149712 A1 * 6/2010 Wang et al. ..... 361/93.2

FOREIGN PATENT DOCUMENTS

CN 101285848 A 10/2008
TW 200849267 12/2008
TW 200905691 2/2009
TW 200912622 3/2009

OTHER PUBLICATIONS

Machine translation for CN101285848A.*

* cited by examiner

*Primary Examiner* — Fritz M Fleming
(74) *Attorney, Agent, or Firm* — Winston Hsu; Scott Margo

(57) ABSTRACT

A system corrected programmable integrated circuit is applied to a power supply and includes a comparator unit, a digital output unit and a programming unit. The comparator unit includes an external feedback voltage input end and a reference voltage input end for inputting a feedback voltage and a reference voltage respectively, such that when the feedback voltage equals the reference voltage, the comparator unit transmits a control signal to the digital output unit. When receiving the control signal, the digital output unit stops outputting the reference voltage and the current reference voltage is recorded as a programming voltage for outputting to the programming unit. When receiving the programming voltage, the programming unit programs the programming voltage and transmits the voltage to the reference voltage input end. Accordingly, the present invention automatically detects and compensates a system error to reduce external element, yet still achieving a qualified range of product specification.

3 Claims, 3 Drawing Sheets

SYSTEM CORRECTED PROGRAMMABLE INTEGRATED CIRCUIT

BACKGROUND OF THE INVENTION a) Field of the Invention

The present invention relates to a programmable integrated circuit, and more particularly to a system corrected programmable integrated circuit which is capable of automatically detecting and compensating a system error to decrease external elements, yet still achieving a qualified range of product specification.

b) Description of the Prior Art

As progressiveness of technology, all kinds of electronic products, such as a computer system, a mobile communication device and a household appliance, have already been tightly connected to our lives. An electronic product must provide a stable power source to drive the electronic product to operate, and usually, an interior of an electronic device will be installed with a power supply to deal with supplying the power source.

A power supply usually provides a stable power source to an electronic device, and in order to achieve this function, a circuit system needs to be designed for the power supply to drive the power supply to operate.

However, upon using the aforementioned power supply, following issue and shortcoming actually exist to be improved.

As in a circuit system of a power supply, all kinds of elements will have different features and every element will have some error values. When applying these elements to a more sophisticated circuit system, these error values will normally result in ill performance of the circuit that an expected function cannot be achieved. Therefore, a mechanism which is able to automatically compensate the error values is required, in order to achieve a more stable circuit function.

Accordingly, how to solve the aforementioned issue and shortcoming of the prior art is to be eagerly researched for improvement by the present inventor and related vendors.

SUMMARY OF THE INVENTION

The primary object of the present invention is to provide an integrated circuit which is able to automatically detect and compensate a system error to reduce external elements, yet still achieving a qualified range of product specification.

To achieve the aforementioned object, the integrated circuit of the present invention, which can be applied to a power supply, includes a comparator unit, a digital output unit and a programming unit. The comparator unit contains an external feedback voltage input end and a reference voltage input end, the external feedback voltage input end can provide for inputting a feedback voltage and the reference voltage input end can provide for inputting a reference voltage continuously, such that when the feedback voltage is equal to the reference voltage, the comparator unit can send out a control signal. The digital output unit can receive the control signal and can provide for outputting the reference voltage continuously, such that when the digital output unit receives the control signal, the reference voltage will stop being outputted and the current reference voltage will be recorded as a programming voltage which is outputted, as well. The programming unit can receive the programming voltage, such that when the programming unit receives the programming voltage, the programming voltage will be programmed and transmitted to the reference voltage input end.

As in a circuit system of a power supply, all kinds of elements will have different features and every element will have some error values. When applying these elements to a more sophisticated circuit system, these error values will normally result in ill performance of the circuit that an expected function cannot be achieved. Therefore, a mechanism which is able to automatically compensate the error values is required. The present invention utilizes a comparator unit which includes an external feedback voltage input end and a reference voltage input end, wherein the external feedback voltage input end can provide for inputting a feedback voltage which can be connected to a place in a circuit system where correction and compensation are required, and the reference voltage input end can provide for inputting a reference voltage continuously, such that when the feedback voltage is equal to the reference voltage, a control signal is transmitted to the digital output unit; when the digital output end receives the control signal, that reference voltage will stop being outputted and the current reference voltage is recorded as a programming voltage which is outputted as well; and the programming unit will then program the programming voltage and transmit the programming voltage to the reference voltage input end. By this mechanism, the present invention is able to automatically detect and compensate a system error to reduce external elements, yet still achieving a qualified range of product specification, so as to effectively improve a yield factor and reliability of product and to further reduce time, cost and manpower.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
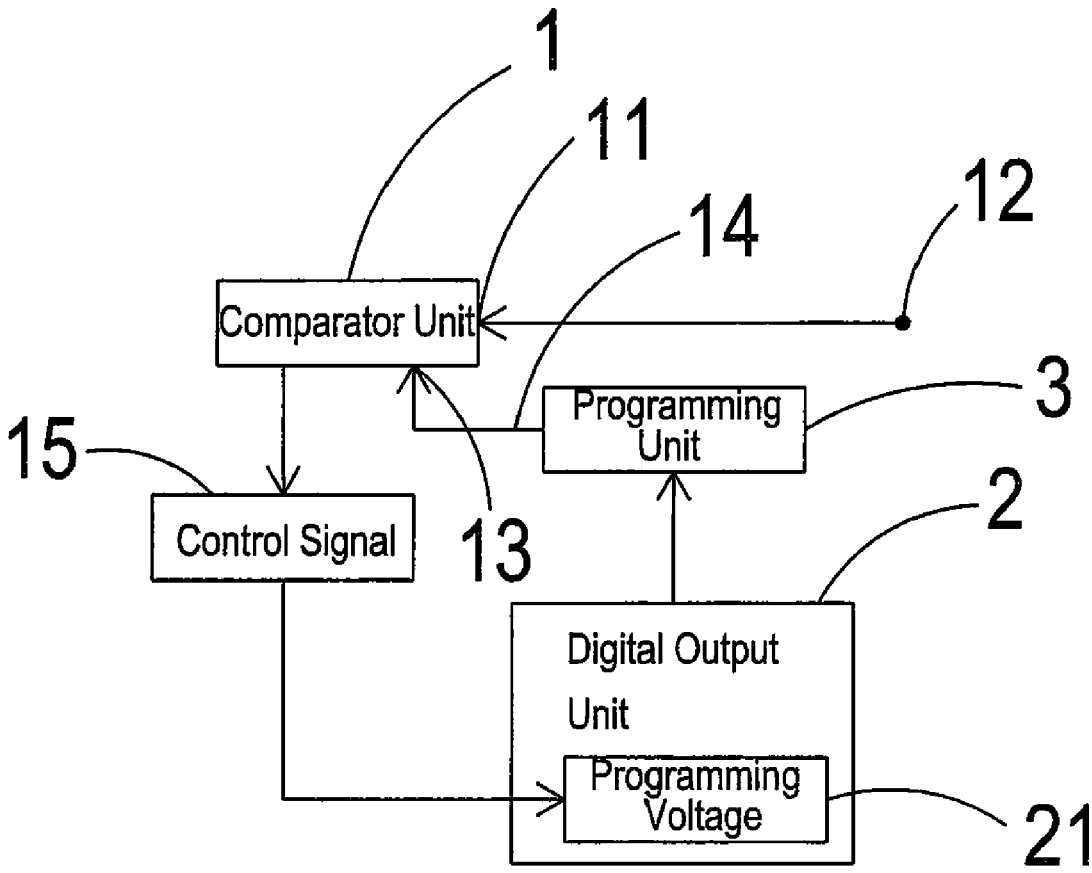
FIG. 1 shows a block diagram of a preferred embodiment of the present invention.
Figure 2:
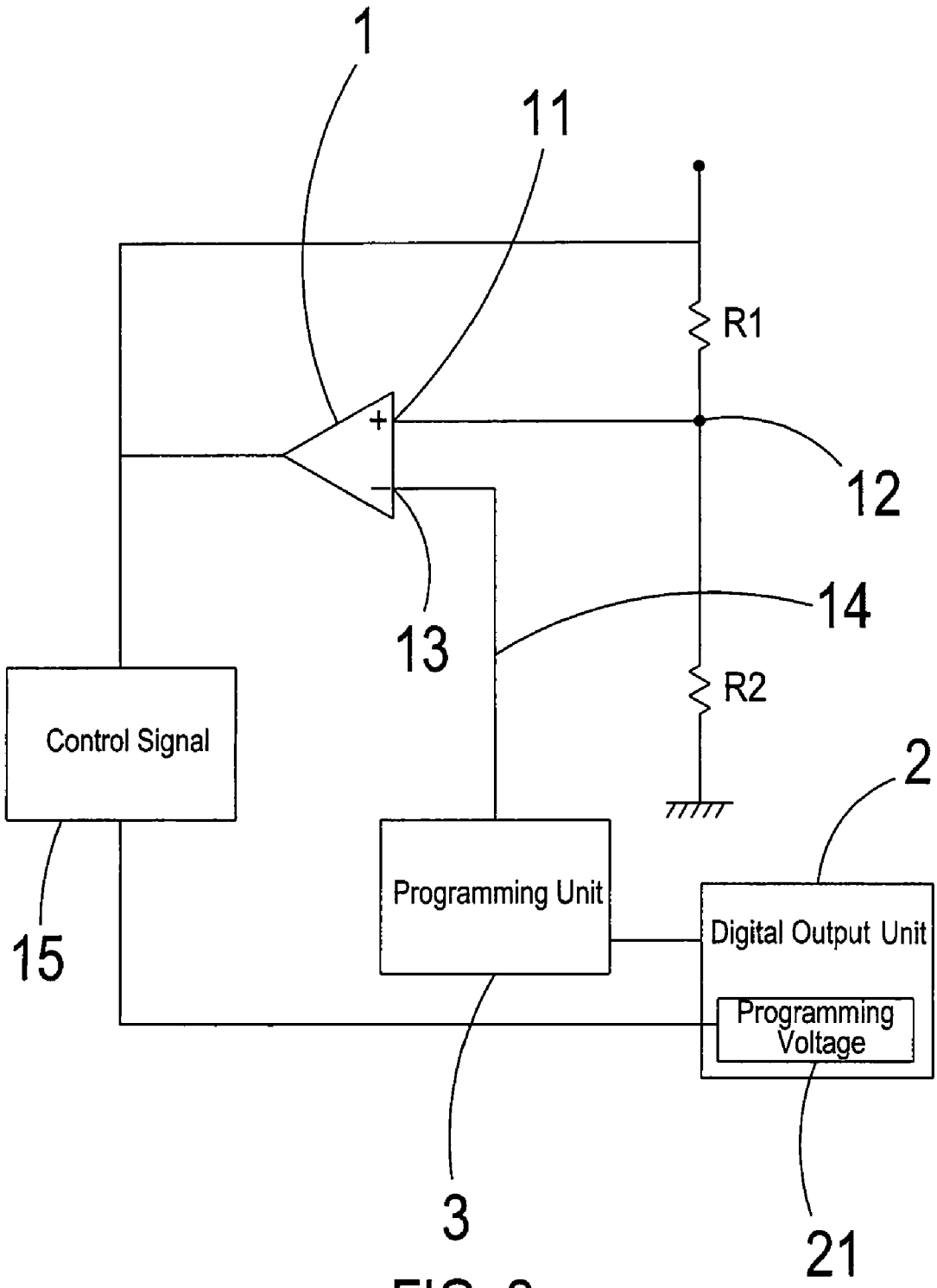
FIG. 2 shows a first schematic view of an implementation of a preferred embodiment of the present invention.

Referring to FIG. 1 and FIG. 2, it shows a block diagram and a first schematic view of an implementation, according to a preferred embodiment of the present invention. As shown in the drawings, the present invention comprises a comparator unit 1 which includes an external feedback voltage input end 11 and a reference voltage input end 13, wherein the external feedback voltage input end 11 allows for inputting a feedback voltage 12 and the reference voltage input end 13 allows for inputting a reference voltage 14 continuously by a stepwise input method (e.g., continuously inputting 1.21V, 1.22V, 1.23V stepwise, but not limited to the voltage values), such that when the feedback voltage 12 is equal to the reference voltage 14, the comparator unit 1 can send out a control signal 15, and the comparator unit 1 can be an amplifier or a comparator; a digital output unit 2 which receives the control signal 15 and can output the reference voltage 14 continuously, such that when the digital output unit 2 receives the control signal 15, the reference voltage 14 will stop being outputted and the current reference voltage 14 is recorded as a programming voltage 21 to be outputted, as well; and a programming unit 3 which receives the programming voltage 21, such that when the programming unit 3 receives the programming voltage 21, the programming voltage 21 is programmed and transmitted to the reference voltage input end 13, with the programming unit 3 being a one-time-programming integrated circuit.

Figure 3:
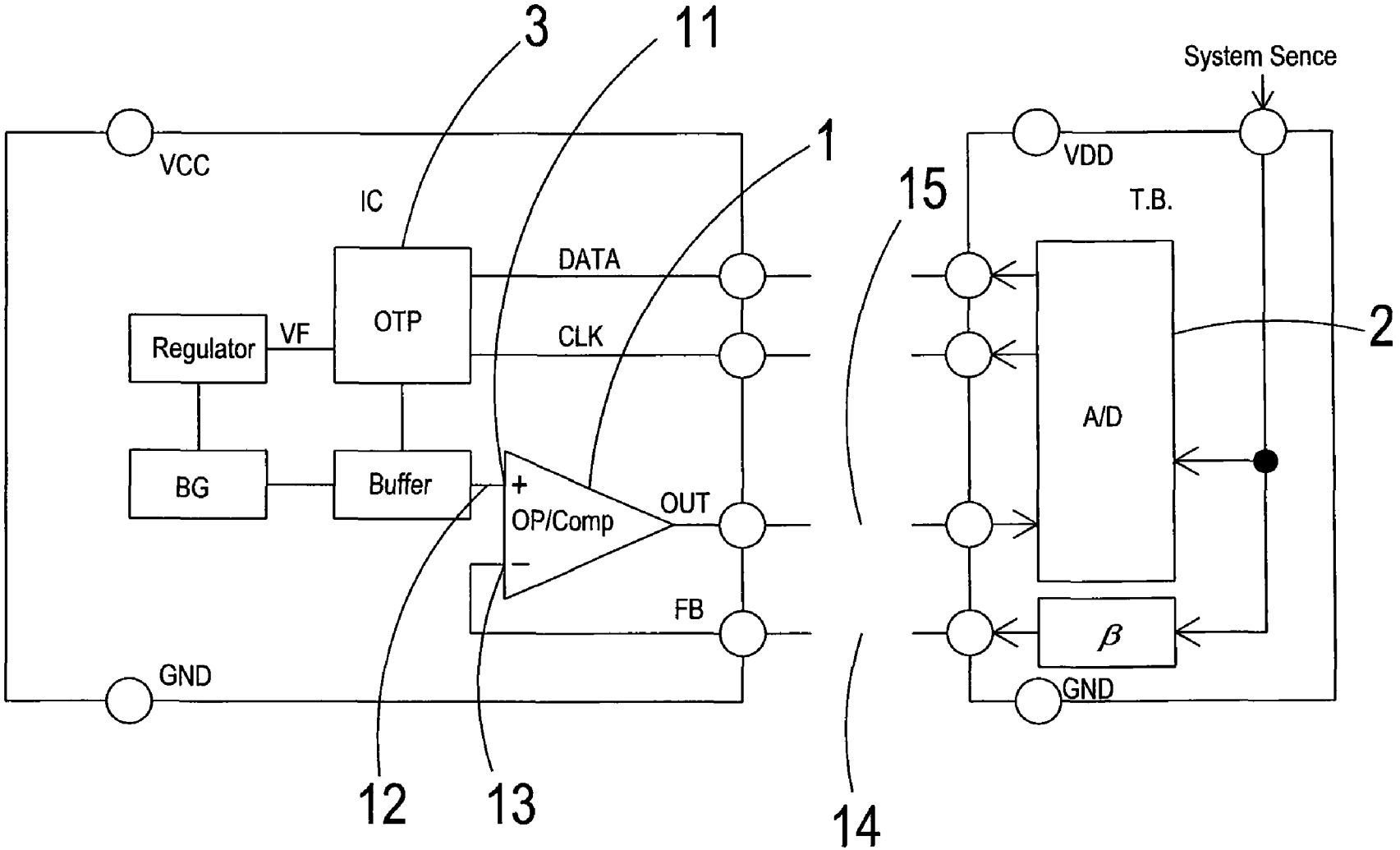
FIG. 3 shows a second schematic view of an implementation of a preferred embodiment of the present invention.

Referring to FIG. 1 and FIG. 3 at a same time, it shows a block diagram and a second schematic view of an implementation, according to a preferred embodiment of the present invention. As shown in the drawings, the present invention can be applied to a power supply and the drawings include the comparator unit 1, the digital output unit 2 and the programming unit 3. As in a circuit system of a power supply, all kinds of elements will have different features and every element will have some error values. When applying these elements to a more sophisticated circuit system (e.g., a power supply circuit system), these error values will normally result in ill performance of the circuit that an expected function cannot be achieved. Therefore, a mechanism which is able to automatically compensate the error values is required. In the present invention, as the comparator unit 1 includes the external feedback voltage input end 11 and the reference voltage input end 13, the feedback voltage 12 can be directly connected in the circuit system, and the reference voltage 14 can be continuously inputted to the reference voltage input end 13 by a stepwise input method (e.g., 1.21V, 1.22V, 1.23V) to continuously increase or decrease the reference voltage 14, such that when the feedback voltage 12 is equal to the reference voltage 14, the comparator unit 1 can send out the control signal 15. On the other hand, the digital output unit 2 can receive the control signal 15 and can output the reference voltage 14 continuously. When the digital output unit 2 receives the control signal 15, the reference voltage 14 will stop being outputted and the current reference voltage 14 will be recorded as the programming voltage 21 which is outputted to the programming unit 3. This programming voltage 21 will be a voltage complying with a system state. In addition, when the programming unit 3 receives the programming voltage 21, the programming voltage 21 is programmed. The programming unit 3 can be the one-time-programming integrated circuit to record the programming voltage 21 in the programming unit 3. Furthermore, the programming unit 3 can also transmit the programming voltage 21 to the reference voltage input end 13. As a result, the present invention can automatically detect and compensate the system error to effectively reduce external elements, yet still achieving the qualified range of product specification, so as to effectively improve the yield factor and reliability of product and to further reduce time, cost and manpower.

Moreover, the present invention utilizes a technology of one-time-programming integrated circuits. Therefore, when being applied to a different circuit, the present invention will automatically detect a system error which needs to be compensated and compensate the error, according to an actual condition. In addition, as the error to be compensated is not same every time, peer vendors cannot copy easily.

Accordingly, the key technologies of the system corrected programmable integrated circuit of the present invention for improving the prior art lie in that when the feedback voltage 12 is equal to the reference voltage 14, the comparator unit 1 can send out the control signal 15 immediately, and when the digital output unit 2 receives the control signal 15, the reference voltage 14 will stop being outputted and the current reference voltage 14 is recorded as the programming voltage 21 which is outputted to the programming unit 3; the programming unit 3 can then program the programming voltage 21 by the one-time-programming method and output the programming voltage 21 to the reference voltage input end 13, with this voltage being the voltage complying with the system state. As a result, the present invention provides the system corrected programmable integrated circuit which can automatically detect and compensate the system error to reduce external elements, yet still achieving the qualified range of product specification.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A system corrected programmable integrated circuit, which is applied to a power supply, comprising a comparator unit which includes an external feedback voltage input end and a reference voltage input end, wherein the external feedback voltage input allows for inputting a feedback voltage and the reference voltage input end allows for inputting a reference voltage continuously, such that when the feedback voltage is equal to the reference voltage, the comparator unit will send out a control signal; a digital output unit which receives the control signal and allows for outputting the reference voltage continuously, such that when the digital output unit receives the control signal, the reference voltage will stop being outputted and the current reference voltage is recorded as a programming voltage which is outputted, as well; and a programming unit which receives the programming voltage, such that when the programming unit receives the programming voltage, the programming voltage is programmed and transmitted to the reference voltage input end.

2. The system corrected programmable integrated circuit according to claim 1, wherein the programming unit is a one-time-programming integrated circuit.

3. The system corrected programmable integrated circuit according to claim 1, wherein the comparator unit is an amplifier or a comparator.

* * * * *